US008690533B2

(12) United States Patent
Burdgick et al.

(10) Patent No.: US 8,690,533 B2
(45) Date of Patent: Apr. 8, 2014

(54) ADJUSTMENT AND MEASUREMENT SYSTEM FOR STEAM TURBINE NOZZLE ASSEMBLY

(75) Inventors: Steven Sebastian Burdgick, Schenectady, NY (US); Daniel Ross Predmore, Ballston Lake, NY (US)

(73) Assignee: General Electric Company, Schenectady, NY (US)

( * ) Notice: Subject to any disclaimer, the term of this patent is extended or adjusted under 35 U.S.C. 154(b) by 671 days.

(21) Appl. No.: 12/946,977

(22) Filed: Nov. 16, 2010

(65) Prior Publication Data

US 2012/0121391 A1 May 17, 2012

(51) Int. Cl.
*F01D 25/24* (2006.01)

(52) U.S. Cl.
USPC ..... 415/213.1

(58) Field of Classification Search
USPC ..... 415/209.2, 201, 213.1, 108, 214.1
See application file for complete search history.

(56) References Cited

U.S. PATENT DOCUMENTS

| | | | | |
|---|---|---|---|---|
| 3,592,557 | A * | 7/1971 | Haas et al. | 415/136 |
| 3,630,635 | A * | 12/1971 | Fatum | 415/214.1 |
| 6,655,911 | B2 | 12/2003 | Bekrenev | |
| 7,207,769 | B2 * | 4/2007 | Tanioka | 415/118 |
| 7,329,098 | B2 | 2/2008 | Burdgick | |
| 8,529,198 | B2 * | 9/2013 | Burdgick | 415/126 |
| 2006/0251514 | A1 | 11/2006 | Burdgick | |
| 2011/0250063 | A1 | 10/2011 | Burdgick et al. | |

OTHER PUBLICATIONS

Flores, U.S. Appl. No. 12/941,634, Notice of Allowance & Fees Due, May 2, 2013, 14 pages.

* cited by examiner

*Primary Examiner* — Richard Edgar
(74) *Attorney, Agent, or Firm* — Hoffman Warnick LLC; Ernest G. Cusick

(57) ABSTRACT

A remote adjustment and measurement system for a steam turbine nozzle assembly is disclosed. In one embodiment, a steam turbine casing segment is disclosed including: a horizontal joint surface; a pocket having a first opening at the horizontal joint surface and a second opening substantially opposing the first opening; and a path accessible from a radially outward surface of the steam turbine casing segment, the path fluidly connected to the second opening of the pocket.

13 Claims, 6 Drawing Sheets

ADJUSTMENT AND MEASUREMENT SYSTEM FOR STEAM TURBINE NOZZLE ASSEMBLY

BACKGROUND OF THE INVENTION

The subject matter disclosed herein relates to a steam turbine nozzle assembly, or diaphragm stage. Specifically, the subject matter disclosed herein relates to an adjustment and measurement system for a steam turbine nozzle assembly.

Steam turbines include static nozzle assemblies that direct flow of a working fluid into turbine buckets connected to a rotatable rotor. The nozzle construction (including a plurality of nozzles, or "airfoils") is sometimes referred to as a "diaphragm" or "nozzle assembly stage." Steam turbine diaphragms include two halves, which are assembled around the rotor, creating horizontal joints between these two halves. Each turbine diaphragm stage is vertically supported by support bars, support lugs or support screws on each side of the diaphragm at the respective horizontal joints. The horizontal joints of the diaphragm also correspond to horizontal joints of the turbine casing, which surrounds the steam turbine diaphragm.

Conventionally, the nozzle assembly stages are aligned either with the rotor in place, or without the rotor, using a hard wire or laser measurement. In one conventional approach, the lower half of the nozzle assembly stage (or, nozzle lower half) and the rotor are aligned without the upper half of the nozzle assembly stage (or, nozzle upper half) and/or the upper half of the turbine casing in place. In this approach, measurements are made between the lower half and the rotor at the bottom and each respective side of the turbine. In a second conventional approach, the nozzle upper half and casing upper half (as well as the respective lower haves) are in place without the rotor. In this approach, measurements are made between the bearing centerline locations and the nozzle assembly centerline. In either approach, the casing, rotor and/or nozzle assemblies must be removed in order to horizontally and vertically align these parts with respect to the rotor. These adjustments may be costly and time-consuming.

BRIEF DESCRIPTION OF THE INVENTION

A remote adjustment and measurement system for a steam turbine nozzle assembly is disclosed. In one embodiment, a steam turbine casing segment is disclosed including: a horizontal joint surface; a pocket having a first opening at the horizontal joint surface and a second opening substantially opposing the first opening; and a path accessible from a radially outward surface of the steam turbine casing segment, the path fluidly connected to the second opening of the pocket.

A first aspect of the invention includes a steam turbine casing segment including: a horizontal joint surface; a pocket having a first opening at the horizontal joint surface and a second opening substantially opposing the first opening; and a path accessible from a radially outward surface of the steam turbine casing segment, the path fluidly connected to the second opening of the pocket.

A second aspect of the invention includes a steam turbine apparatus having: a diaphragm segment; a casing segment at least partially housing the diaphragm segment, the casing segment having: a horizontal joint surface; a pocket having a first opening at the horizontal joint surface and a second opening substantially opposing the first opening; and a path accessible from a radially outward surface of the steam turbine casing segment, the path fluidly connected to the second opening of the pocket; a support member positioned within the pocket; a support bar at least partially coupling the casing segment to the diaphragm segment, the support bar contacting the support member; and an adjustment member within the path and contacting the support member, the adjustment member configured to actuate movement of the support bar via the support member.

A third aspect of the invention includes a steam turbine system having: an upper casing segment; and a lower casing segment coupled to the upper casing segment at a casing horizontal joint surface, the lower casing segment including: a pocket having a first opening at the casing horizontal joint surface and a second opening substantially opposing the first opening; and a path accessible from a radially outward surface of the steam turbine casing segment, the path fluidly connected to the second opening of the pocket.

BRIEF DESCRIPTION OF THE DRAWINGS

These and other features of this invention will be more readily understood from the following detailed description of the various aspects of the invention taken in conjunction with the accompanying drawings that depict various embodiments of the invention, in which.

It is noted that the drawings of the invention are not to scale. The drawings are intended to depict only typical aspects of the invention, and therefore should not be considered as limiting the scope of the invention. In the drawings, like numbering represents like elements between the drawings.

DETAILED DESCRIPTION OF THE INVENTION

Aspects of the invention provide for an adjustment and measurement system for a steam turbine nozzle assembly. In some embodiments, aspects of the invention provide for a remote screw adjustment and measurement system for a steam turbine nozzle assembly.

In contrast to conventional approaches, aspects of the invention provide for an adjustment and measurement system for a steam turbine that reduces the time, cost and labor involved in aligning the steam turbine nozzle assembly, casing and rotor. In one embodiment, aspects of the invention provide for a steam turbine apparatus including an adjustment and measurement system. This steam turbine apparatus may include: a diaphragm segment; a casing segment at least partially housing the diaphragm segment, the casing segment having: a horizontal joint surface; a pocket having a first opening at the horizontal joint surface and a second opening substantially opposing the first opening; and a path accessible from a radially outward surface of the steam turbine casing segment, the path fluidly connected to the second opening of the pocket; a support member positioned within the pocket; a support bar at least partially coupling the casing segment to the diaphragm segment, the support bar contacting the support member; and an adjustment member within the path and contacting the support member, the adjustment member configured to actuate movement of the support bar via the support member.

Figure 1:
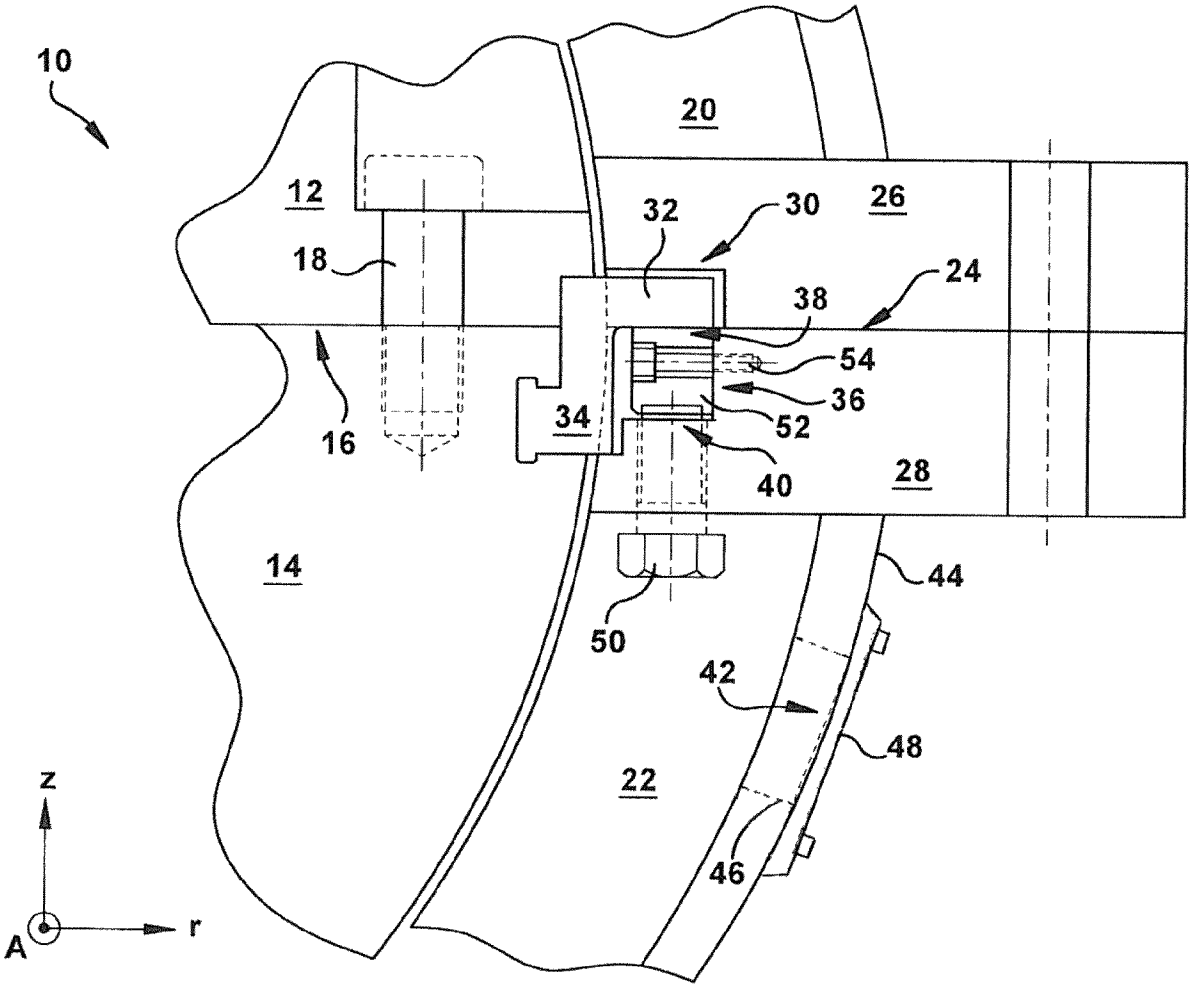
FIG. 1 shows a partial end elevation of a steam turbine apparatus according to embodiments of the invention.

Turning to FIG. 1, a partial end elevation of a steam turbine apparatus 10 is shown according to embodiments of the invention. In one embodiment, the steam turbine apparatus 10 may include an upper diaphragm segment 12 and a lower diaphragm segment 14 joined at a diaphragm horizontal joint surface 16 (interface between diaphragm segments). In one embodiment, upper diaphragm segment 12 and lower diaphragm segment 14 may be joined by at least one bolt 18. Also shown at least partially housing diaphragm segments (12, 14) is a casing, including an upper casing segment 20 and a lower casing segment 22 joined at a casing horizontal joint surface 24 (interface between casing segments). In one embodiment, upper casing segment 20 and lower casing segment 22 may each include a support arm 26, 28, respectively. As shown, upper casing segment 20 may include a slot 30 configured to receive an overhanging portion 32 of a support bar 34, as is known in the art. Lower casing segment 22 may include a pocket 36 having a first opening 38 at the casing horizontal joint surface 24 (first opening 38 obscured in this two-dimensional view). Pocket 36 may further include a second opening 40 substantially opposing the first opening 38.

Lower casing segment 22 is further shown including a port 42 accessible from a radially outward surface 44 of lower casing segment 22. In one embodiment, port 42 is fluidly connected to second opening 40 via, e.g., a channel or path 46 (and through open cavity of lower casing segment 22). In one embodiment port 42 (and consequently, path 46) may be fluidly isolated from an area external to the radially outward surface 44 by an access plate 48 or other removably affixed cover. It is understood that in embodiments, an operator (e.g., a human operator) may remove access plate 48 in order to access path 46 e.g., to adjust an adjustment member 50 (explained further herein).

Also shown included in steam turbine apparatus 10 is a support member 52 positioned within pocket 36. In one embodiment, support member 52 may be configured to contact support bar 34 and may be configured to vertically support the support bar 34 at overhanging portion 32. In one embodiment, support member 52 may include a substantially block-shaped member formed of a metal including, e.g., steel. Support member 52, in some cases, may be removably affixed to lower casing segment 22 (e.g., at support arm 28) via a bolt 54 or other attachment mechanism. For example, in some cases, support member 52 may be removably affixed to lower casing segment 22 via a pin, a screw, or a dovetail connection (where a complementary dovetail connection is formed within lower casing segment 22). In one embodiment, lower casing segment 22 may include an aperture (e.g., a threaded aperture that may extend substantially radially outward) configured to receive bolt 54 or another attachment mechanism for retaining support member 52 within pocket 36. In another embodiment shown and described herein, a pocket may substantially circumferentially retain a support member such that the support member is not bolted to the lower casing segment.

Also shown in FIG. 1 is adjustment member 50, located within lower casing segment 22 and at least partially located within the second opening 40 of pocket 36. It is understood that portions of lower casing segment 22 are open to path 46, such that lower casing segment 22 includes a cavity by which adjustment member 50 can be accessed via path 46. Adjustment member 50 may be configured to actuate movement of support bar 34 via contact (and/or attachment with) the support member 52. That is, adjustment member 50 may be configured to adjust a position of support member 52 (e.g., by raising or lowering adjustment member 50 while it is in contact with and/or removably attached to support member 52). In one embodiment, adjustment member 50 may include a partially threaded bolt or screw, configured to be rotated by e.g., an operator in order to actuate movement of adjustment member 50 along the Z-axis. In some embodiments, adjustment member 50 may be retained by a retaining member (not visible in this perspective) such as a retaining plate, tab, wire, etc. configured to fix adjustment member 50 in a desired position along the Z-axis. In one embodiment, support member 52 may include an aperture configured to receive a portion of the adjustment member 50, where the aperture may include a counter-bore portion for retaining adjustment member 50 at a position with respect to support member 52.

It is understood that aspects of the invention allow for adjustment of the position (e.g., the vertical position along the Z-axis) of the casing horizontal joint surface 24 with respect to the diaphragm horizontal joint surface 16. More specifically, aspects of the invention allow for adjustment of the position of the casing horizontal joint surface 24 with respect to the diaphragm horizontal joint surface 16 from a location external to a radially outward wall 44 of the casing (e.g., lower casing segment 22). This adjustment may be performed in order to align the respective horizontal joint surfaces (diaphragm 16 and casing 24). In contrast to conventional approaches of aligning the casing and diaphragm horizontal joint surfaces, the steam turbine apparatus 10 shown according to embodiments allows for alignment of the casing and diaphragm horizontal joint surfaces while the casing and diaphragm segments, respectively, are bolted together or otherwise closed. That is, aspects of the invention reduce the time, labor and costs associated with conventional steam turbine horizontal joint surface alignment. As is described further herein, aspects of the invention also allow for a measurement system that is capable of aligning portions of a steam turbine while the diaphragm and casing segments, respectively, are joined.

Figure 2:
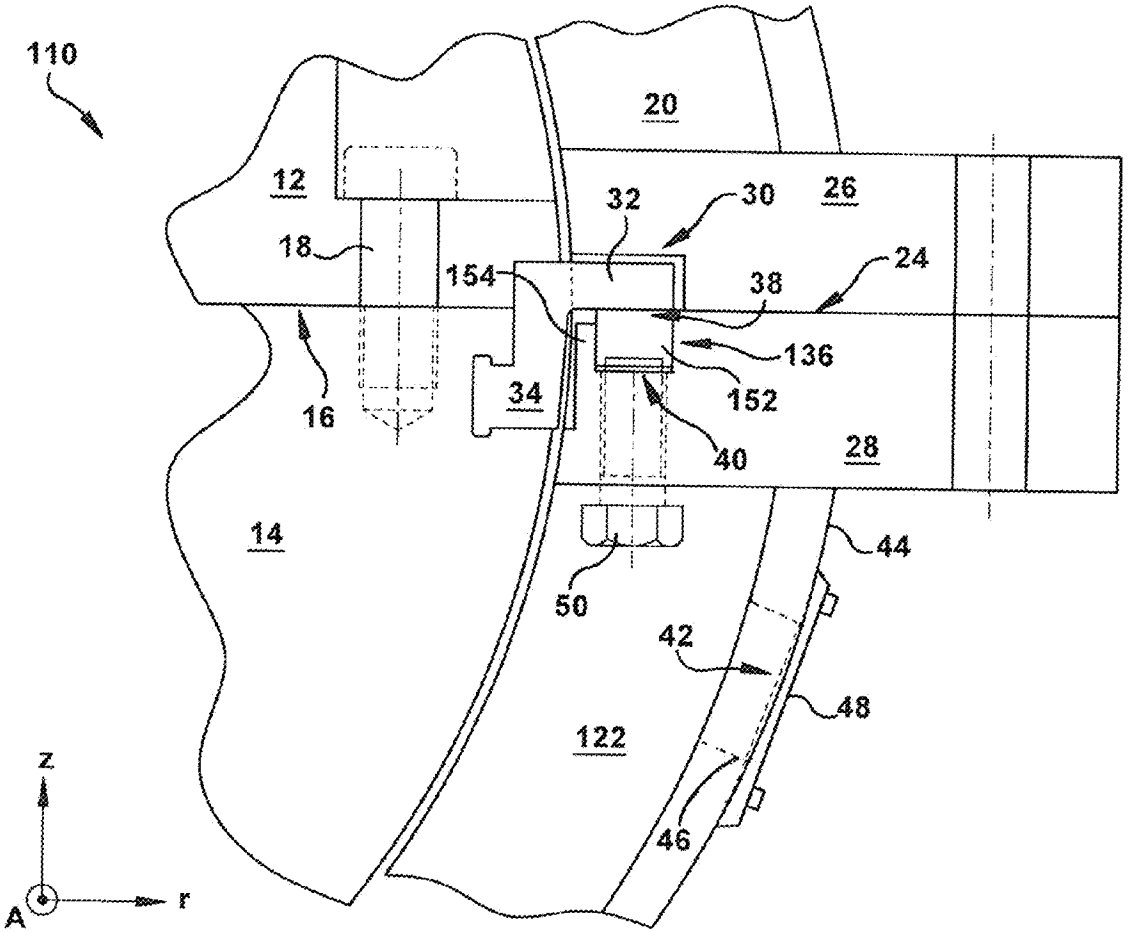
FIG. 2 shows a partial end elevation of a steam turbine apparatus according to another embodiment of the invention.

FIG. 2 shows a partial end elevation of a steam turbine apparatus 110 according to alternate embodiments of the invention. It is understood that similarly labeled elements between FIGS. 1 and 2 may represent substantially similar elements. Explanation of those elements has been omitted herein for brevity. In this alternate embodiment, steam turbine apparatus 110 may include a lower casing segment 122 (including a support arm 128) having substantially circumferential pocket 136. In this case, substantially circumferential pocket 136 may include a radially retaining portion 154 configured to retain support member 152 radially outwardly. In one embodiment, substantially circumferential pocket 136 (or, pocket) may surround support member 152 circumferentially (along the radial axis, r) such that support member 152 is radially retained within pocket 136. In this case, in contrast to the steam turbine apparatus 10 of FIG. 1, a retaining member (e.g., retaining member 54) may not be used to maintain a position of support member 152 within the pocket. Without the use of retaining member 54 (FIG. 1), lower casing segment 122 (including support arm 128) may not have an aperture for receiving a retaining member (as in FIG. 1). This may allow for avoidance of machining used in forming the aperture for receiving a retaining member. Additionally, without use of the retaining member 54 (FIG. 1), support member 152 may be formed without an aperture extending therethrough, which may reduce machining or fabrication costs in forming support member 152 as compared with support member 52 (FIG. 1). In one embodiment, pocket 136 may be machined within lower casing segment 122 to form retaining portion 154. In another embodiment, retaining portion 154 may be welded, brazed or otherwise adjoined to lower casing segment 122 in order to retain support member 152. As will be described further herein, pocket 136 may allow for support member 152 to be slid into pocket 136 from opening 38 at the casing horizontal joint surface 24. As with lower casing segment 22 of FIG. 1, it is understood that portions of lower casing segment 122 are open to path 46, such that lower casing segment 122 includes a cavity by which adjustment member 50 can be accessed via path 46.

Figure 3:
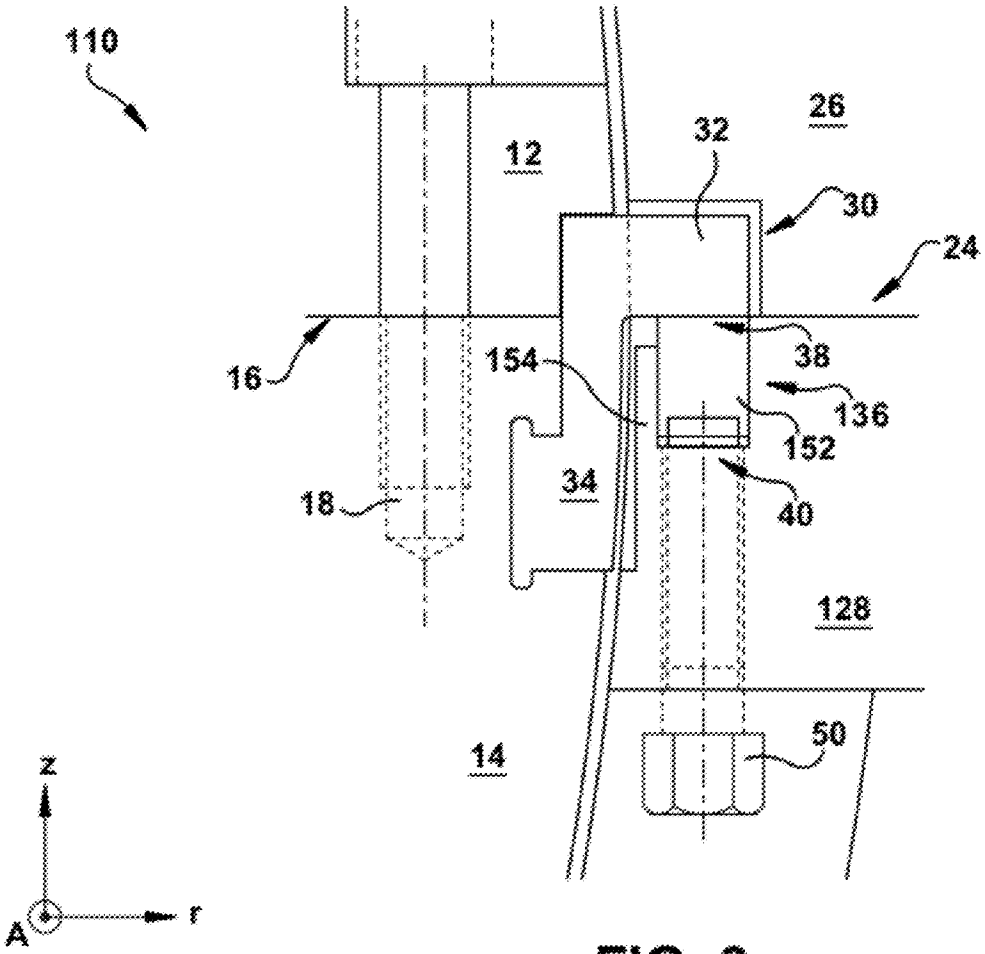
FIG. 3 shows a close-up view of the partial end elevation depiction of the steam turbine apparatus of FIG. 2.

FIG. 3 shows a close-up view of the partial end elevation depiction of the steam turbine apparatus 110 of FIG. 2. As shown, and similarly to steam turbine apparatus 10 of FIG. 1, steam turbine apparatus 110 is configured to allow for adjustment of the casing horizontal joint surface 24 with respect to the diaphragm horizontal joint surface 16. That is, steam turbine apparatus 110 allows adjustment member 50 to move along the Z-axis to actuate movement of the support member, and consequently, the support bar 34 (via contact at the overhanging portion 32). In this case, as the support bar 34 is adjusted, so too is the diaphragm horizontal joint surface 16. It is understood that path 46 is omitted in FIG. 3 for clarity.

Figure 4:
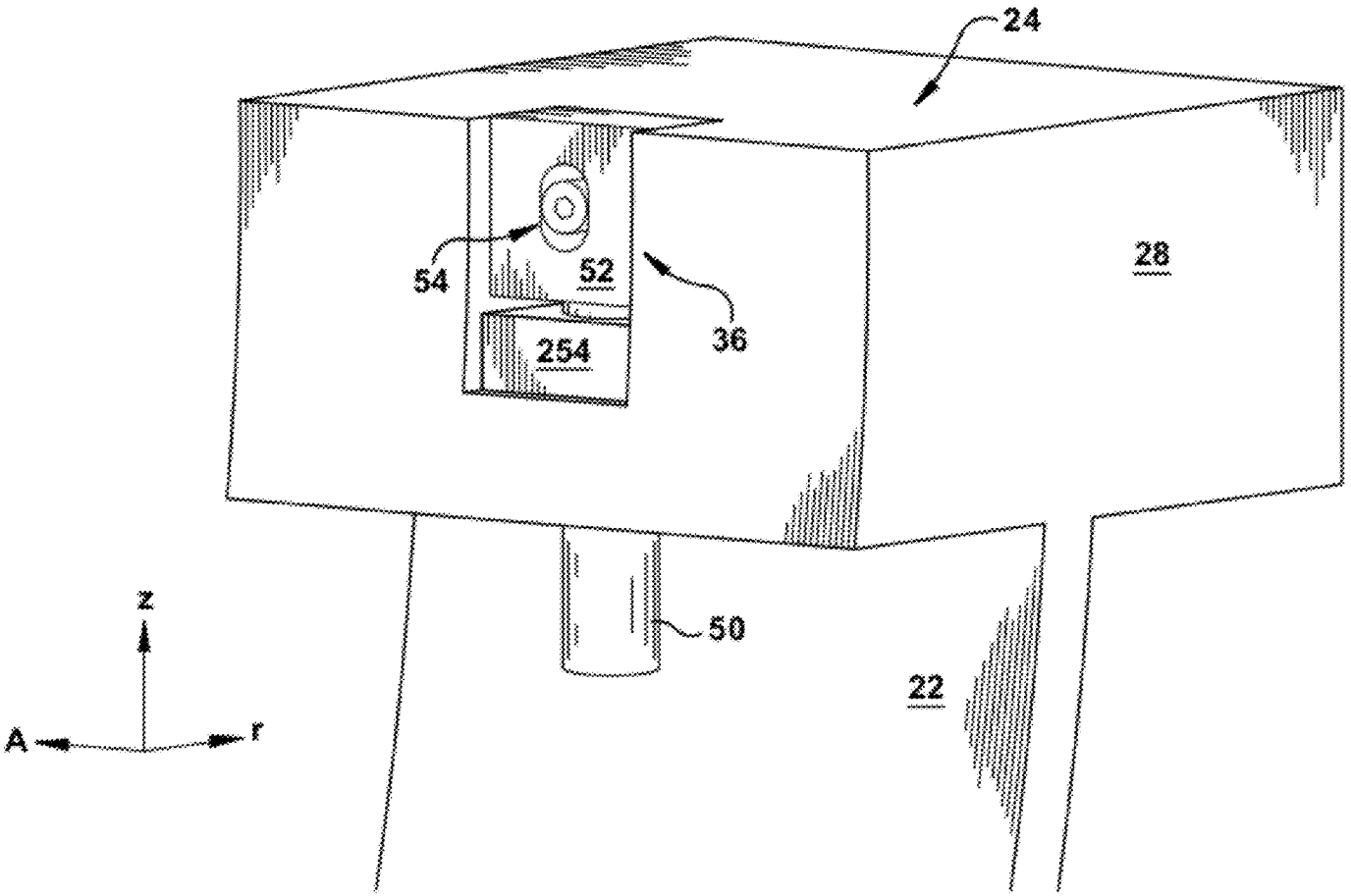
FIG. 4 shows a partial cut-away three-dimensional perspective view of portions of a steam turbine apparatus according to embodiments of the invention.

FIG. 4 shows a partial cut-away three-dimensional view of the lower casing segment 22, as well as a support member 52 located within pocket 36. Also shown is bolt 54 (e.g., a retaining shoulder bolt) or other attachment mechanism. It is understood that path 46 and associated port 42 are omitted for clarity of illustration. Additionally shown in FIG. 4 is a retainment block 254, which may in some embodiments, be located within pocket 36 (and/or pocket 136 in the embodiments described with reference to FIGS. 2-3). Retainment block 254 may be used to retain a position (e.g., a position along the Z-axis) of adjustment member 50 within pocket 36. In one embodiment, retainment block 254 may include a counterbored section for retaining a vertical position of adjustment member 50 (and consequently, a position of casing horizontal joint surface 24 relative to diaphragm horizontal joint surface 16 (not shown). In one embodiment, retainment block 254 may interact with support member 52 (e.g., by contacting support member 52) and act as an interface between the relatively narrow cross-sectional area of adjustment member 50 (e.g., a bolt) as compared to the relatively wide cross-sectional area of adjustment block 52. Use of retainment block 254 in this manner may decrease the stress placed on adjustment member 50 by the weight of support member 52, support bar 34, and diaphragm segments 12, 14 (not shown).

Figure 5:
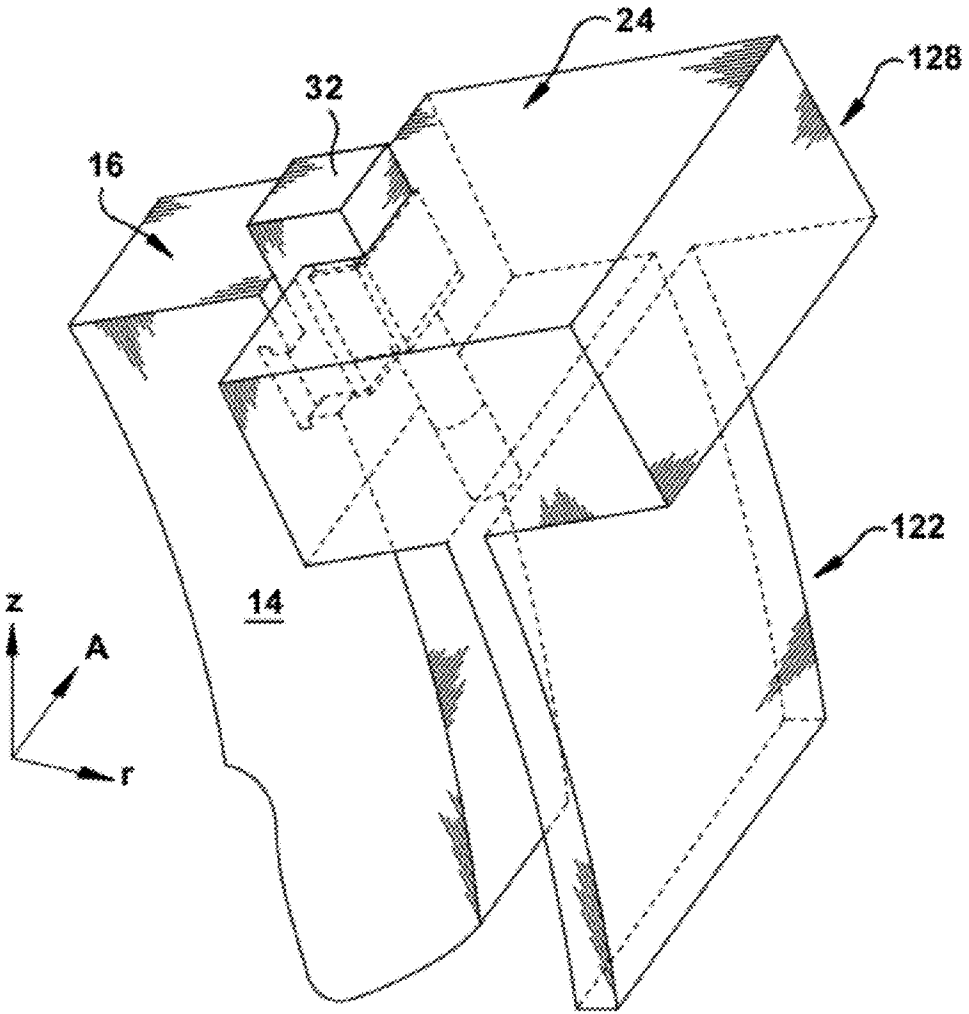
FIG. 5 shows a three-dimensional perspective view of portions of a steam turbine apparatus according to embodiments of the invention.

FIG. 5 shows a three-dimensional perspective view of a portion of the steam turbine apparatus of FIGS. 2-3. It is understood that some components are hidden due to this perspective view. Further, it is understood that path 46 and associated port 42 are omitted for clarity of illustration. However, as can be seen through the semi-transparent lower casing section 122 in FIG. 5, an axially extending bolt e.g., as in FIG. 1, may be omitted in this embodiment, such that support member 152 (shown labeled in FIGS. 2-3) may be retained substantially by pocket 136 having a retaining portion 154.

Figure 6:
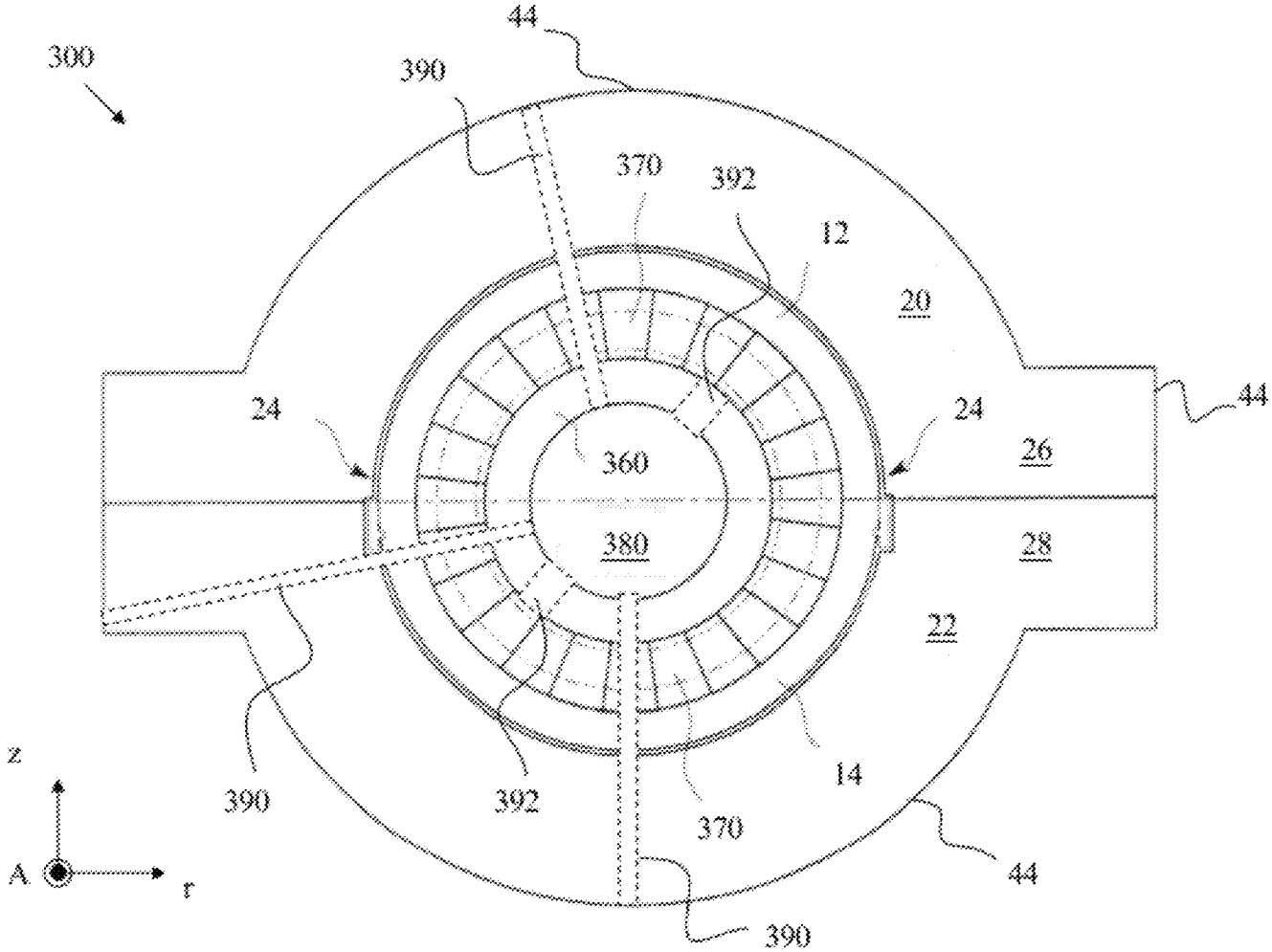
FIG. 6 shows a partial cross-sectional view of a steam turbine system according to embodiments of the invention.

FIG. 6 shows a partial cross-sectional view of a steam turbine system 300 according to embodiments of the invention. It is understood that similarly labeled elements between the Figures herein may represent substantially similar elements. It is further understood that path 46 and associated port 42 (as well as details of support bar 34) are omitted for clarity of illustration. As shown, steam turbine system 300 may include diaphragm ring segments 12, 14. Diaphragm ring segments 12, 14 are housed within casing segments 20, 22 (or, alternatively, 20 and 122, as shown and described with reference to other embodiments), respectively, which are joined at casing horizontal joint surface 24. In this depiction, casing horizontal joint surface 24 and diaphragm horizontal joint surface 16 are assumed to be aligned, and therefore, diaphragm horizontal joint surface 16 is omitted for clarity of illustration. Each diaphragm ring segment 12, 14, supports a semi-annular row of turbine nozzles 370 and an inner web 360, as is known in the art. The diaphragm ring segments 12, 14 collectively surround a rotor 380, as is known in the art. Also shown included in steam turbine system 300 is an aperture 390 (several shown) extending radially from the rotor 380 to the radially outward surface 44. Aperture 390 may be located axially (A-axis, into the page) between stages of the steam turbine system 300 (stages obstructed in this view), and in one embodiment, aperture 390 may be substantially sealed from the radially outward surface 44, via, e.g., a cover plate, plug, or other removably affixed seal. In another embodiment, one or more apertures 390 may extend through a turbine nozzle 370 and/or through a nozzle sidewall, thereby intersecting the steam flow path. In one embodiment, aperture 390 may be located at the bottom-dead-center location of steam turbine system 300, or slightly off from bottom dead center. In other embodiments, aperture 390 may be located proximate to the horizontal joint surfaces (16, 24) of casing and diaphragm. Further, multiple apertures 390 (e.g., four, approximately evenly spaced around the circumference of steam turbine system 300) may be formed within steam turbine system 300 to allow for access to the rotor 380 from a point external to the radially outward surface 44. In one embodiment, apertures 390 may be configured to receive a probe or other measurement member to calculate a distance between portions of casing, diaphragm and/or rotor. It is understood that apertures 390 are located between stages of steam turbine system 300, such that apertures 390 do not physically interfere with turbine nozzles 370 (indicated by phantom lines). In an alternative embodiment, one or more linear variable differential transformer(s) (LVDT) 392 may be placed between the rotor 380 and the diaphragm ring 12 (e.g., the turbine nozzles 370 within diaphragm ring 12) to collect and transmit data regarding positioning and movement of the diaphragm ring 12 and rotor 380. LVDT 392 may be any conventional linear variable differential transformer configured to transfer the physical movement of an element to which it is attached to an electrical signal, as is known in the art. LVDT 392 may be hard-wired to a receiving system (e.g., a conventional receiver or other computerized system) or may be wirelessly connected to the receiving system. In any case, LVDT 392 may be configured to determine a position and/or movement of diaphragm ring 12 and rotor 380. In another embodiment, a conventional piezoelectric-based device and/or a conventional capacitance device may be used in place of LVDT 392 to determine position and/or movement of the diaphragm ring 12 and rotor 380. In some embodiments, these devices (e.g., LVDT 392, piezoelectric-based device or capacitance device) may only have to survive the initial static conditions of the steam turbine system 300. That is, in some embodiments, one or more of these types of devices will be relatively ineffective for collecting and/or transmitting positional or movement-related data after operation of the steam turbine system 300 begins.

In contrast to conventional steam turbine systems, steam turbine system 300 may allow for determination of the positional relationships between a rotor, diaphragm, and casing at one or more locations along the circumference of the system. Specifically, steam turbine system 300 may provide for measurement of positional relationships of its components while the system is closed (e.g., where casing segments 20, 22, diaphragm segments 12, 14 and rotor 380 are in place. This system 300 may reduce the time and expense of measurement associated with conventional systems that require removal of at least some components (e.g., casing, diaphragm and/or rotor) in order to conduce measurements.

The terminology used herein is for the purpose of describing particular embodiments only and is not intended to be limiting of the disclosure. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

What is claimed is:

1. A steam turbine casing segment comprising:

a horizontal joint surface;

a pocket having a first opening at the horizontal joint surface and a second opening substantially opposing the first opening, wherein the pocket is configured to retain a support member substantially circumferentially;

a path accessible from a radially outward surface of the steam turbine casing segment, the path fluidly connected to the second opening of the pocket;

a port accessible from the radially outward surface and fluidly connected to the second opening of the pocket;

a removably affixed access plate configured to cover the path at the radially outward surface, wherein the port and the removably affixed access plate are both located below the horizontal joint surface along the radially outward surface;

an adjustment member within the path, the adjustment member extending at least partially into the pocket; and a retaining member configured to retain the adjustment member within the path.

2. The steam turbine casing segment of claim 1, further comprising a radially extending slot configured to receive the retaining member.

3. A steam turbine apparatus comprising:

a diaphragm segment;

a casing segment at least partially housing the diaphragm segment, the casing segment having:

a horizontal joint surface;

a pocket having a first opening at the horizontal joint surface and a second opening substantially opposing the first opening;

a support member positioned within the pocket;

wherein the pocket is configured to retain the support member substantially circumferentially; and a path accessible from a radially outward surface of the steam turbine casing segment, the path fluidly connected to the second opening of the pocket;

a support bar at least partially coupling the casing segment to the diaphragm segment, the support bar contacting the support member; and an adjustment member within the path and contacting the support member, the adjustment member configured to actuate movement of the support bar via the support member.

4. The steam turbine apparatus of claim 3, wherein the adjustment member includes a substantially vertically extending bolt.

5. The steam turbine apparatus of claim 3, further comprising a retaining member configured to retain the adjustment member within the path.

6. The steam turbine apparatus of claim 5, wherein the retaining member includes at least one of: a plate, a tab or a wire.

7. A steam turbine system comprising:

a diaphragm ring;

an upper casing segment; and a lower casing segment coupled to the upper casing segment at a casing horizontal joint surface, wherein the upper casing segment and the lower casing segment surround the diaphragm ring, the lower casing segment including:

a pocket having a first opening at the casing horizontal joint surface and a second opening substantially opposing the first opening;

a support member positioned within the pocket, wherein the pocket is configured to retain the support member substantially circumferentially; and a path accessible from a radially outward surface of the steam turbine casing segment, the path fluidly connected to the second opening of the pocket and a support bar at least partially coupling the casing segment to the diaphragm segment, the support bar contacting the support member.

8. The steam turbine system of claim 7, wherein the upper casing segment and the lower casing segment are coupled by at least one bolt.

9. The steam turbine system of claim 7, wherein the diaphragm ring includes an upper diaphragm segment coupled to a lower diaphragm ring segment at a diaphragm horizontal joint surface.

10. The steam turbine system of claim 9, further comprising:

an adjustment member within the path contacting the support member, the adjustment member being accessible from the radially outward surface of the steam turbine casing segment and being configured to adjust a position of the casing horizontal joint surface relative to a position of the diaphragm horizontal joint surface.

11. The steam turbine system of claim 7, further comprising a rotor positioned radially inside of the diaphragm ring.

12. The steam turbine system of claim 11, further comprising an aperture extending from the rotor to the radially outward surface between two stages of the steam turbine system, the aperture configured to receive a measurement probe.

13. The steam turbine system of claim 11, further comprising at least one of a linear variable differential transformer, a piezoelectric-based device, or a capacitance-based device, removably affixed to the diaphragm ring and in contact with the rotor.

* * * * *